US008231034B2

(12) United States Patent
Styles et al.

(10) Patent No.: US 8,231,034 B2
(45) Date of Patent: Jul. 31, 2012

(54) HAT BRIM PROTECTOR AND SHAPER

(75) Inventors: Jonathan D. Styles, Needham, MA (US); Barry M. Parent, Windsor (CA)

(73) Assignee: VistaPrint Technologies Limited, Hamilton (BM)

( * ) Notice: Subject to any disclaimer, the term of this patent is extended or adjusted under 35 U.S.C. 154(b) by 1137 days.

(21) Appl. No.: 12/020,965

(22) Filed: Jan. 28, 2008

(65) Prior Publication Data

US 2009/0188951 A1 Jul. 30, 2009

(51) Int. Cl.
*A42C 1/04* (2006.01)

(52) U.S. Cl. ..... 223/14; 223/12

(58) Field of Classification Search ..... 223/7, 12, 223/14, 15, 24, 21, 26
See application file for complete search history.

(56) References Cited

U.S. PATENT DOCUMENTS

| | | | | |
|---|---|---|---|---|
| 2,295,475 | A | 9/1942 | Hurxthal | |
| 4,491,256 | A | 1/1985 | Payne | |
| 5,163,589 | A | 11/1992 | Biehl | |
| 5,399,418 | A * | 3/1995 | Hartmanns et al. | 428/218 |
| 5,685,465 | A | 11/1997 | Berardis | |
| 5,862,522 | A | 1/1999 | Cho | |
| 5,908,146 | A * | 6/1999 | Levin | 223/84 |
| 6,129,250 | A | 10/2000 | Cho | |
| 6,824,027 | B2 * | 11/2004 | Frey | 223/14 |
| 6,840,411 | B2 * | 1/2005 | Fritz | 223/24 |
| D513,835 | S * | 1/2006 | Robinson | D2/892 |
| 7,097,080 | B2 * | 8/2006 | Cox | 223/84 |
| 7,150,048 | B2 * | 12/2006 | Buckman | 2/465 |
| 2008/0035683 | A1 * | 2/2008 | Wynn | 223/15 |

FOREIGN PATENT DOCUMENTS

| | | | |
|---|---|---|---|
| GB | 635162 | A | 4/1950 |

* cited by examiner

*Primary Examiner* — Shaun R Hurley
*Assistant Examiner* — Andrew Sutton
(74) *Attorney, Agent, or Firm* — Jessica J. Costa

(57) ABSTRACT

A hat pallet for use in a printer which prints an image onto a hat of the type having a cap and a brim attached thereto includes a bottom plate and a top plate mountable in a closed position over the bottom plate. The bottom plate includes a printing plate and a brim support fixedly mounted thereon. The top plate has an opening exposing at least a portion of the printing plate when the top plate is in the closed position. The brim support is positioned relative to the printing plate such that when the hat is mounted in the pallet with the top plate in the closed position, a portion of the cap on which the image is to be printed is supported on the printing plate and exposed through the opening of the top plate and the underside of the brim of the hat is supported by the brim support.

19 Claims, 6 Drawing Sheets

HAT BRIM PROTECTOR AND SHAPER

FIELD OF THE INVENTION

This invention relates to direct printing of images on brimmed hats, and more particularly to a novel protector for a hat brim for use in high-temperature drying of the hat.

BACKGROUND OF THE INVENTION

Direct printing of images or graphic designs onto apparel such as t-shirts and hats is typically performed by a high-speed digital image printer which prints ink onto an item of apparel. In order to prevent bleeding of ink, after printing, the printed area is typically cured by way of an ultra-violet (UV) curing lamp, an infra-red (IR) curing lamp, hot air, etc. For example, baseball caps printed with an image using a digital inkjet printer may be passed through a high-temperature (e.g., 350° F.) dryer to cure the ink. Furthermore, because industrial direct digital printers typically print according to a CMYK printing process in which the colors Cyan, Magenta, Yellow, and Black are each printed on separate layers, the printing and curing process requires several passes of the hat through the printer and dryer.

In items of apparel that include plastic or other material that melts under the high drying/curing temperatures, the curing of the printed image may actually cause damage to elements of the item of apparel. For example, a baseball cap typically is formed with a plastic insert inside the brim of the hat as a stiffener and to maintain shape the brim. When the baseball cap is subjected to the curing process, the plastic inside the brim may melt or deform, which is clearly an undesired effect. Accordingly, a need exists for a hat brim protector and shaper which prevents damage to the brim of the hat and which simultaneously operates to fix the shape of the brim during the curing process.

SUMMARY

Embodiments of the invention are directed at protecting and shaping the brim of a hat during the curing process in direct digital image printing on the hat.

In accordance with one embodiment of the invention, a brim protector for a hat of the style including a cap with a brim attached thereto, includes a mitt having a cavity conforming to a desired brim shape and having an opening to the cavity conforming to a cross-section of the desired brim shape for inserting the brim of the hat therein, the mitt covering the entire brim when the brim is fully inserted into the mitt cavity, the mitt comprising a stiff heat-resistant material.

In accordance with another embodiment of the invention, a method for protecting a brim of a hat of the style of a cap with a brim includes inserting the brim of the hat fully into a mitt, the mitt having a cavity conforming to a desired brim shape and having an opening to the cavity conforming to a cross-section of the desired brim shape for inserting the brim of the hat therein, the mitt covering the entire brim when the brim is fully inserted into the mitt cavity, the mitt comprising a stiff heat-resistant material, exposing the hat with brim inserted into the mitt to drying means, and removing the hat from the mitt to produce a dry hat with a brim shaped into the desired brim shape.

In accordance with another embodiment of the invention, a method for making a brim protector for a hat comprising a cap having a brim attached thereto, includes forming a mitt configured with a cavity conforming to a desired brim shape and having an opening to the cavity conforming to a cross-section of the desired brim shape for inserting the brim of the hat therein, the mitt covering the entire brim when the brim is fully inserted into the mitt cavity, the mitt comprising a stiff heat-resistant material.

In accordance with another embodiment of the invention, a dryer conveyance system includes a conveyor which passes through a dryer, and at least one brim protector attached to the conveyor, the brim protector configured to protect a brim of a hat, the hat comprising the brim attached to a cap, the brim protector comprising a mitt having a cavity conforming to a desired brim shape and having an opening to the cavity conforming to a cross-section of the desired brim shape for inserting the brim of the hat therein, the mitt covering the entire brim when the brim is fully inserted into the mitt cavity, the mitt comprising a stiff heat-resistant material It is an advantage of the invention that the brim of the hat is fully protected during drying or exposure to high temperatures and that during the drying process, the brim of the hat is shaped into a desired brim shape.

These and other objects, features and advantages of the invention will be better understood with reference to the accompanying drawings, description and claims.

DETAILED DESCRIPTION

It will be understood that, while the discussion herein describes an embodiment of the invention in the field of printing images on baseball caps, it will be understood that the invention is not so limited and is relevant to any application for drying or curing a brim of a hat under high temperatures.

Figure 1A:
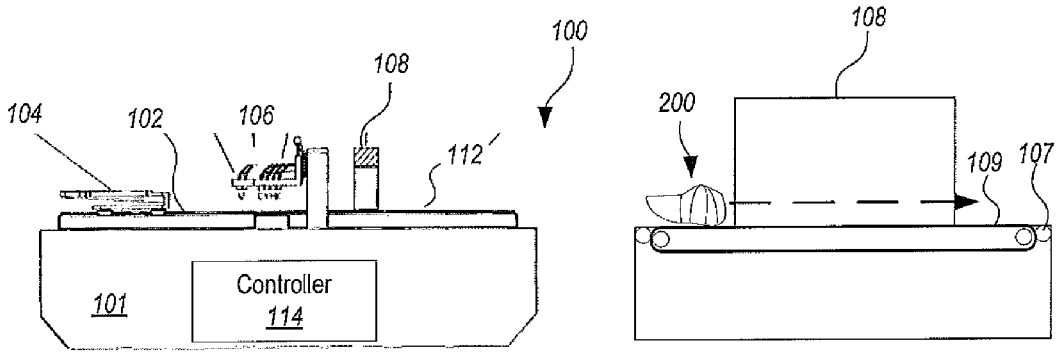
FIG. 1A is a side view of a digital image printing system for printing digital images directly onto apparel.
Figure 1B:
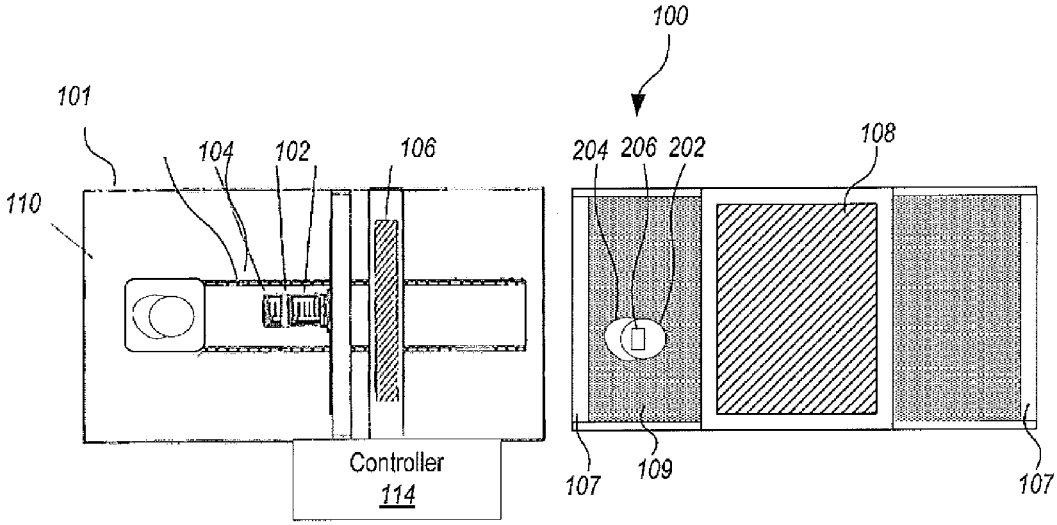
FIG. 1B is a top view of the digital image printing system of FIG. 1A.

FIGS. 1A and 1B illustrate a digital image printing system 100 for printing digital images directly onto apparel such as t-shirts and hats. The printing system includes a printer 101 having a printing table 102 having a pallet 104 mounted thereon for holding an apparel piece 110. The printer 100 also includes an array of inkjet print heads 106. The printing table 102 is mounted on a conveyance system 112 which conveys the printing table 102 along a pre-determined path past the operative ends of the print heads 106. The conveyance system 112 may be any automated or manual means for conveying the printing table 102 along the pre-determined path. For example, in one embodiment, the conveyance system 112 is an automated conveyor belt system under the control of a computer program. In another embodiment, the conveyance system 112 is a set of rollers over which the printing table slides when manually guided by a human operator.

A controller 114 is coupled to the printer 101 for causing printing of a digital image 205 (see FIG. 1B) on the apparel piece 110 on the pallet 104 as the printing table 102 passes the print heads 106. For a color image, the printing of the image is achieved by placing ink drops at different adjacent sites as discreet, physically non-mixed drops. The ink composition used must prevent the drops from "bleeding" on the applied media. In the illustrated embodiment, the image is printed by an array of color printing heads 114. The image is printed using subtractive primary colors: Cyan, Yellow, Magenta, and Black (CYMK), for example, using transparent ink. When printing on dark colored apparel, a layer of white ink may first be printed prior to printing the CYMK process. The printing may require a single pass, or series of passes, to complete the printing of the image on the apparel piece 110.

After the printing process is complete, the printed item of apparel is placed on a conveyance mechanism, such as a conveyor belt 109, which transports the item past the dryer 108 to cures the ink deposited by the inkjet printing heads 106. The dryer 108 can be any drying mechanism, such as a hot air generator, an oven, etc.

Figure 2:
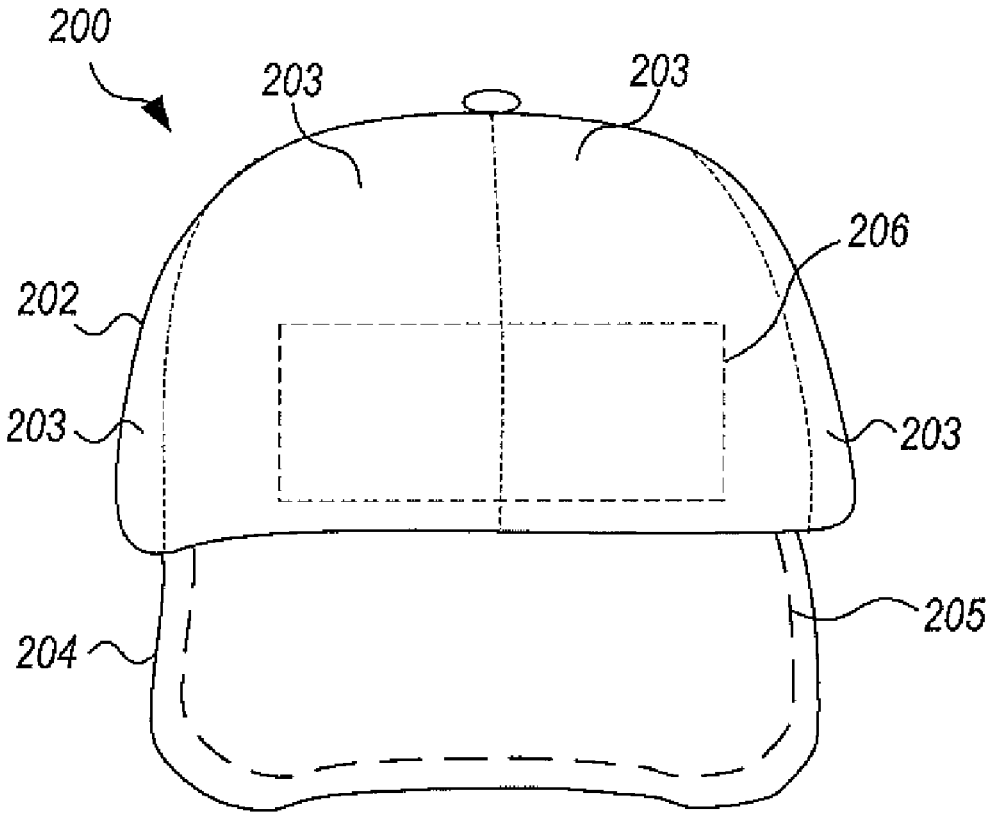
FIG. 2 is a front view of a traditional baseball cap.
Figure 3A:
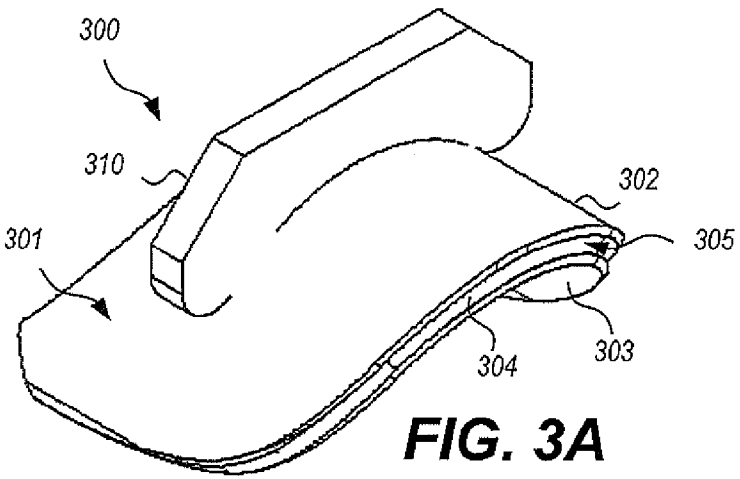
FIG. 3A is a perspective view of an exemplary embodiment of a hat brim protector.
Figure 3B:
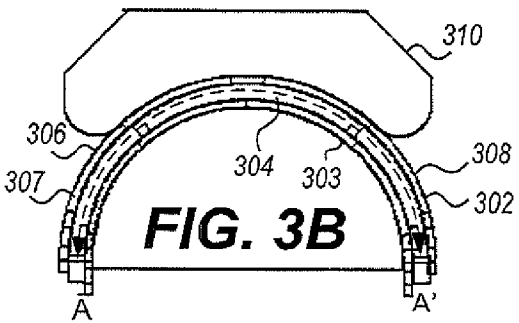
FIG. 3B is a front view of the hat brim protector of FIG. 3A where a hat may be inserted into the opening of the protector.
Figure 3C:
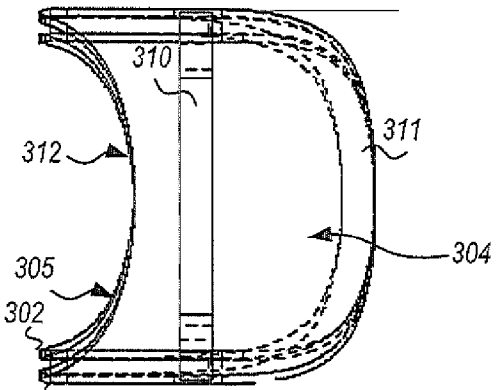
FIG. 3C is a top-down view of the hat brim protector of FIGS. 3A-3B.
Figure 3D:
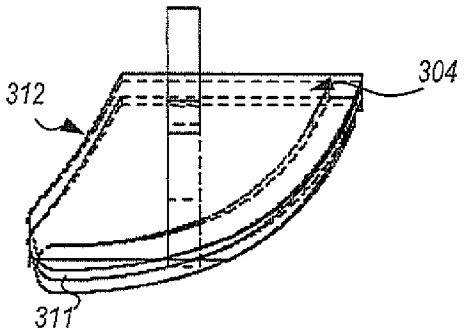
FIG. 3D is a side view of the hat brim protector of FIGS. 3A-3C.

FIG. 2 depicts a standard baseball cap 200. As shown, the baseball cap 200 includes a soft cap 202, for example made of fabric, with a brim 204 in the form of a long, stiffened and curved peak. The cap 202 may be fitted. Alternatively, the back of the cap 202, not shown, may include an adjustor strap made from plastic, Velcro, or elastic, so that it can be quickly adjusted to fit the size of the head of the wearer. The cap 202 is generally hemispherically shaped wherein the 3-dimensional curves are achieved by sewing a plurality of sections 203 together. Since the brim 204 is traditionally worn over the eyes, the printed image 206 is typically printed on the cap 202 above the brim 204. The brim 204 is typically formed with a stiffener 205 covered with fabric to maintain the shape of the brim 204. The stiffener 205 often comprises a plastic or other material that may be damaged or otherwise deform under drying temperatures (for example, 350° F.).

FIGS. 3A-3D together illustrate an exemplary embodiment of a novel hat brim protector 300 for a baseball cap 200. As illustrated in FIGS. 3A-3D, the hat brim protector 300 comprises a mitt 301 having top piece 302 and a bottom piece 303 enclosing a cavity 304 conforming to a desired brim shape and providing an opening 305 to the cavity 304 conforming to a cross-section A-A of the desired brim shape of the hat. At least the top piece 302, and preferably also the bottom piece 303 of the mitt 301, is made of a stiff heat-resistant material 306 such as polytetrafluaroethylene, for example commercially known under the Trademark Teflon®, which may or may not be reinforced with a stiff material such as steel (e.g., steel reinforced polytetrafluaroethylene material) and may include an insulative material 307 layered between the inner cavity 304 and the stiff heat-resistant material 306. The outer surface of the mitt may be coated in a heat deflection coating 308 such as a polytetrafluaroethylene (for example, Teflon®) with a poly paraphenylene terephthalamide coating (for example, as known commercially under the Trademark Kevlar®). In one embodiment, the edge 312 of the mitt 301 where the opening 305 is located is curved to follow the curve of the brim 204 where the brim 204 is attached to the cap of the hat 200.

A heat-resistant handle 310 is attached to an outer surface of the mitt 301. While the embodiments shown have the handle 310 positioned on the top piece 302 of the mitt 301, it will be appreciated that the handle 310 may be alternatively attached in different locations on the mitt 301, such as along the edge opposite the opening 305, or even on the bottom piece 303. The handle 310 is made from a heat resistant material, and is preferably coated with a heat deflection coating.

Figure 4:
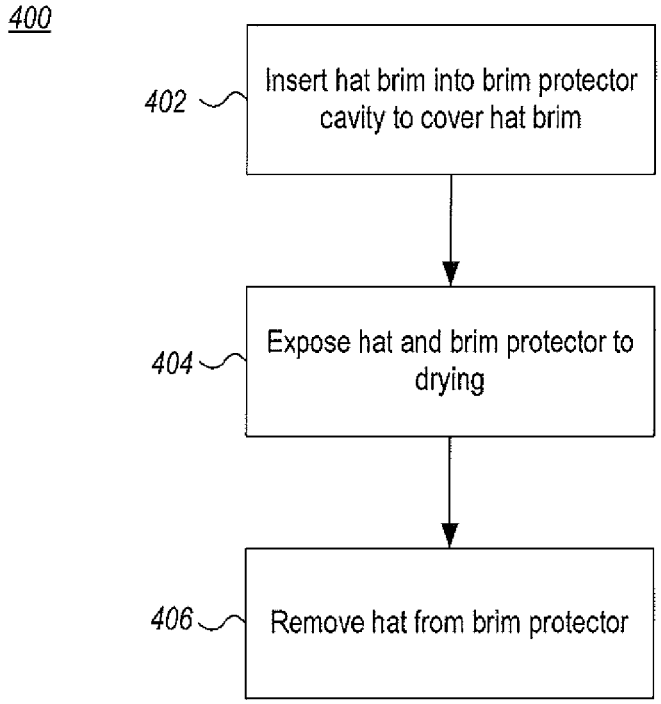
FIG. 4 is a flowchart illustrating an exemplary embodiment of a method for protecting a brim of a hat.

FIG. 4 is a flowchart illustrating a method 400 for protecting a brim of a hat configured with a brim connected to a cap. As illustrated, the method includes inserting the brim of the hat fully into the cavity of the mitt through the mitt opening (step 402). The mitt is one such as shown in FIGS. 3A-3D, comprising a stiff heat-resistant material and wherein the cavity conforms to a desired brim shape. Preferably, while the brim is fully covered by the mitt, the cap itself remains unencumbered by the mitt, with little or no part of the mitt actually covering any portion of the cap.

Returning to the method 400, once the brim of the hat is fully inserted into the cavity of the mitt, the hat, together with the brim protector covering the brim, is exposed to drying means (step 404). For example, the hat may be placed on a conveyor belt which transports the hat 200 past a high-pressure, high-temperature hot-air dryer 108 or some other hot radiation means such as an oven, Because the mitt 301 itself is formed of heat-resistant material, exposure to high temperatures does not melt or otherwise damage the plastic (or other material) stiffening insert 205 inside the brim 204 of the hat 200. Furthermore, because the mitt is formed of a stiff material, such as steel reinforced polytetrafluaroethylene, the brim is forced to conform to the shape of the mitt cavity 304, which is the desired brim shape. After exposure to the drying means, the hat 200 is then removed from the mitt 301 (step 406), with the result being a dry hat having a brim shaped into the desired brim shape.

Figure 5:
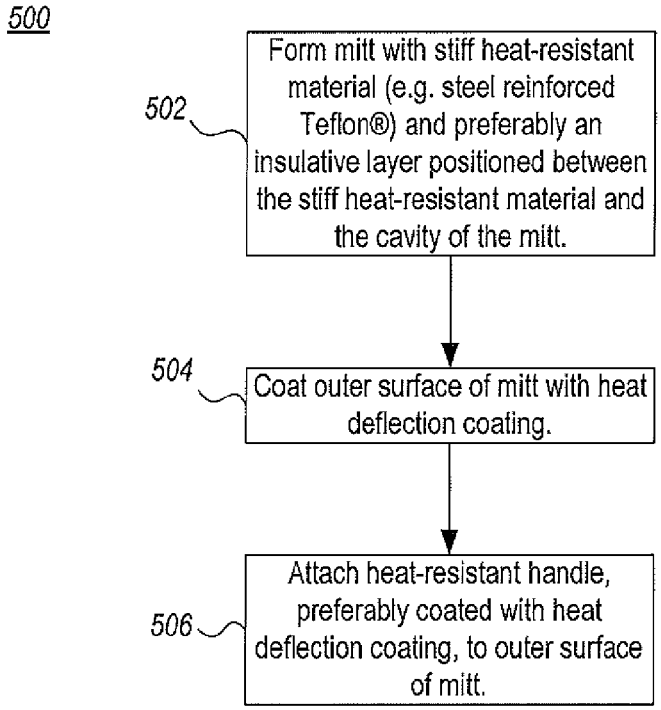
FIG. 5 is a flowchart illustrating an exemplary embodiment of a method for making a brim protector for a hat.
Figure 6A:
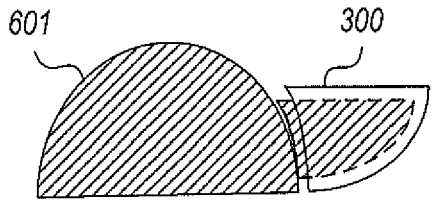
FIG. 6A is a side view of another exemplary embodiment of a hat brim protector.
Figure 6B:
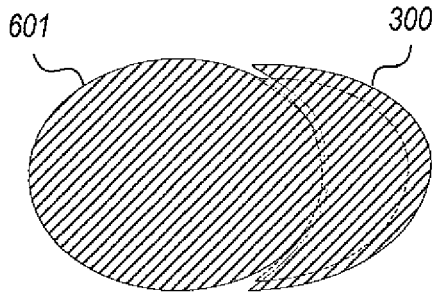
FIG. 6B is a top-down view of the hat brim protector of FIG. 3A.
Figure 6C:
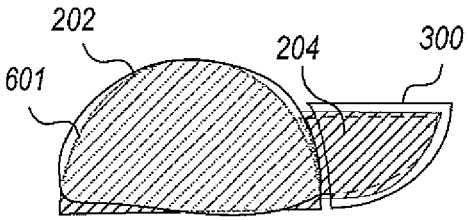
FIG. 6C is a side view of the hat brim protector of FIGS. 3A-3B with a hat mounted on the protector.
Figure 6D:
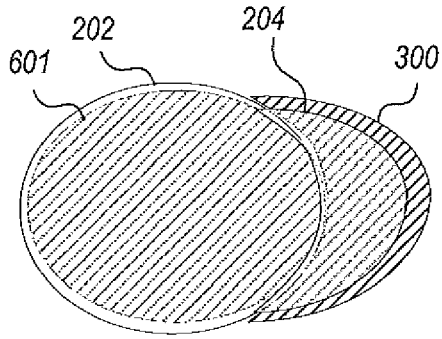
FIG. 6D is a top-down view of the hat brim protector of FIGS. 3A-3C with a hat mounted on the protector.

FIG. 5 illustrates a method 500 for making the brim protector embodied herein. In this method 500, a mitt 301 is formed of a stiff heat-resistant material (step 502), the mitt 301 configured with a cavity 304 conforming to a desired brim shape and having an opening 305 to the cavity conforming to a cross-section of the desired brim shape for inserting the brim 204 of the hat 200 therein. In one embodiment, the mitt is formed in a mold with Teflon® as the mitt material. In one embodiment, the polytetrafluaroethylene is a rigid material of approximately ⅜" thickness. Preferably, the mitt 301 is configured to fully cover the entire brim when the brim is fully inserted into the mitt cavity yet leaves the cap 202 fully exposed. In one embodiment, the stiff heat-resistant material comprises steel reinforced polytetrafluaroethylene. Also, the mitt may be further formed with an insulative material layered between the inner cavity and the stiff heat-resistant material. The method 500 may also include the step of coating the outer surface of the mitt with a heat deflection coating, such as polytetrafluaroethylene with a poly paraphenylene terephthalamide coating (step 504). The method may further include the step of attaching a heat-resistant handle, preferably coated with a heat deflection coating, to an outer surface of the mitt (step 506).

FIGS. 6A-6D illustrates an enhancement to the brim protector of FIGS. 3A-3D. The enhancement is a cap support 601 attached to the brim protector 300 which supports the cap 202 of the hat 200 while the brim 204 of the hat 200 is fully inserted into the mitt cavity 304. As illustrated, in one embodiment, the cap support 601 is an oval hemisphere which mimics the top portion of a head. The illustrated embodiment of the cap support 601 is shown by way of illustration only and not limitation. Any cap support means which supports the cap so that the fabric of the cap is maximally exposed may be implemented in its place.

Figure 7A:
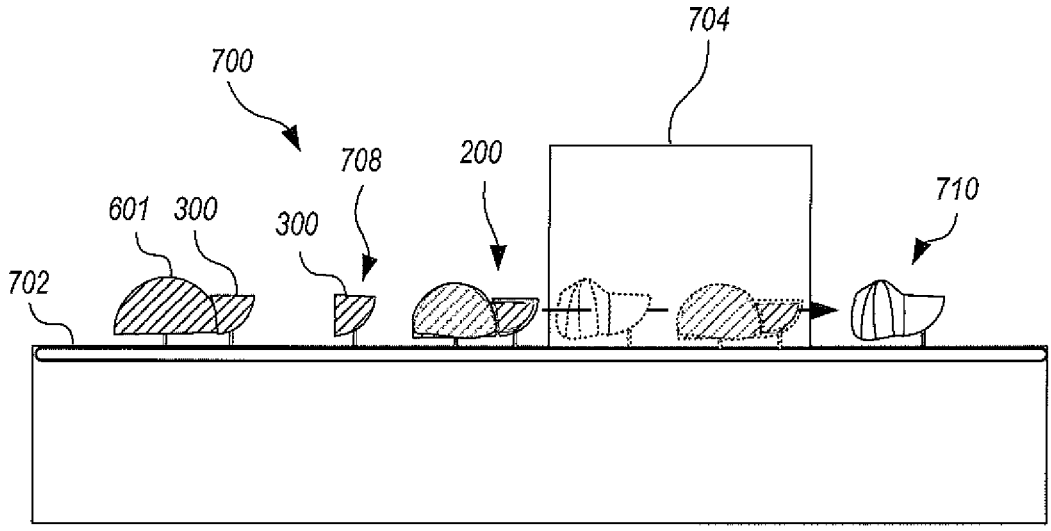
FIG. 7A is side view of a dryer conveyance system.
Figure 7B:
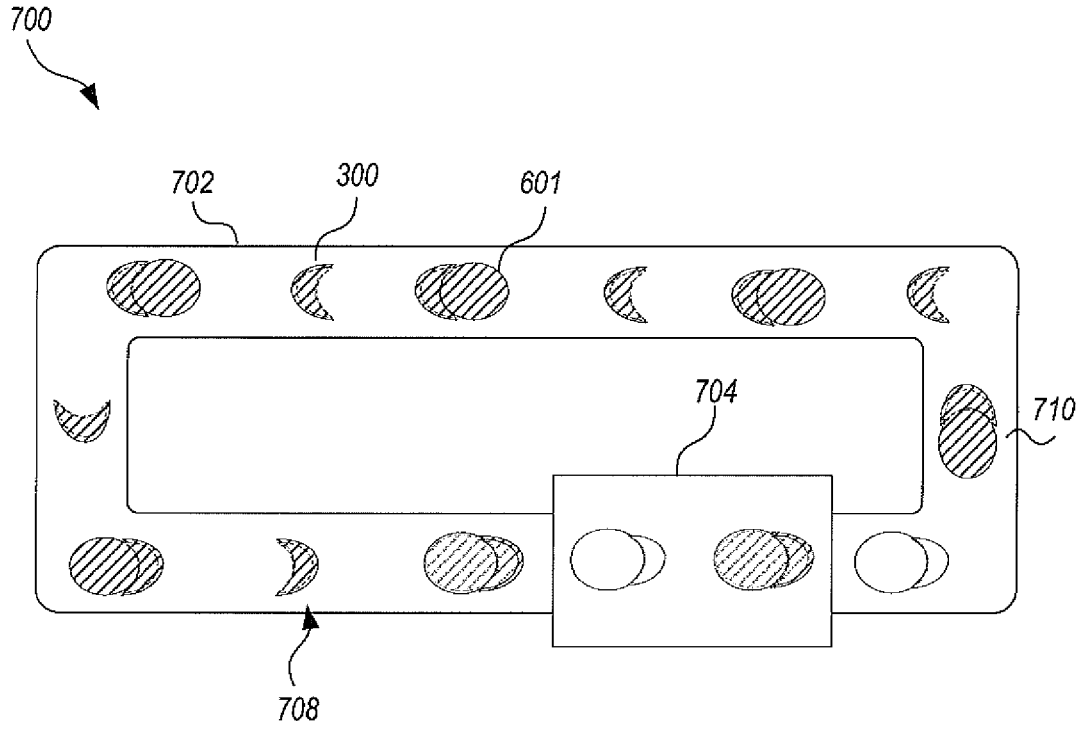
FIG. 7B is a top-down view of a dryer conveyance system.

FIGS. 7A and 7B show a dryer conveyance system 700 having multiple brim protectors fixedly attached to a conveyance mechanism 702 (e.g. a conveyor belt) of the conveyance system 700. The conveyance mechanism 702 transports the brim protectors in a continuous loop past a dryer mechanism 704. Hats 200 may be inserted in a brim protector 300 as it passes by a loading station 708 and may be removed from the brim protector 300 when it reaches an unloading station 710. The continuous loop allows maximum efficiency in loading and unloading multiple hats in an assembly line manner. Alternatively, or additionally, the brim protectors may include a cap support 601 such as shown in the embodiment of FIGS. 6A-6D.

Variations of the illustrated brim protector may be implemented without departing from the scope of the claimed invention.

While an exemplary embodiment of the invention has been discussed, the described embodiment is to be considered as illustrative rather than restrictive. The scope of the invention is as indicated in the following claims and all equivalent methods and systems.

What is claimed is:

1. A brim protector for a hat, the hat comprising a cap having a brim attached thereto, the brim protector comprising:

a mitt having a cavity conforming to a desired brim shape and having an opening to the cavity conforming to a cross-section of the desired brim shape for inserting the brim of the hat therein, the mitt covering the entire brim when the brim is fully inserted into the mitt cavity, the mitt comprising a stiff heat-resistant material and an insulative material layered between the mitt cavity and the stiff heat-resistant material.

2. The brim protector of claim 1, wherein the stiff heat-resistant material comprises steel reinforced polytetrafluaroethylene.

3. The brim protector of claim 1, further comprising:

an outer surface comprising a heat deflection coating.

4. The brim protector of claim 3, wherein the heat deflection coating comprises polytetrafluaroethylene with a poly paraphenylene terephthalamide coating.

5. The brim protector of claim 1, further comprising:

a heat-resistant handle attached to an outer surface of the mitt.

6. The brim protector of claim 5, the handle having an outer surface comprising a heat deflection coating.

7. The brim protector of claim 6, attached to a conveyance system which transports a hat through a dryer, wherein the hat is positioned with the brim of the hat fully inserted in the mitt cavity.

8. The brim protector of claim 1, further comprising a cap support attached to the brim protector which supports the cap of the hat while the brim of the hat is fully inserted into the mitt cavity.

9. The brim protector of claim 8, attached to a conveyance system which transports a hat through a dryer, wherein the hat is positioned with the cap of the hat on the cap support and the brim of the hat fully inserted in the mitt cavity.

10. A dryer conveyance system, comprising:

a conveyor which passes through a dryer;

at least one brim protector attached to the conveyor, the brim protector configured to protect a brim of a hat, the hat comprising the brim attached to a cap, the brim protector comprising a mitt having a cavity conforming to a desired brim shape and having an opening to the cavity conforming to a cross-section of the desired brim shape for inserting the brim of the hat therein, the mitt covering the entire brim when the brim is fully inserted into the mitt cavity, the mitt comprising a stiff heat-resistant material and an insulative material layered between the mitt cavity and the stiff heat-resistant material.

11. The dryer conveyance system of claim 10, wherein the conveyer follows a looped path.

12. The dryer conveyance system of claim 10, wherein the at least one brim protector further comprises a cap support attached to the brim protector which supports the cap of the hat while the brim of the hat is fully inserted into the mitt cavity.

13. A method for protecting a brim of a hat, the hat comprising the brim connected to a cap, the method comprising:

inserting the brim of the hat fully into a mitt, the mitt having a cavity conforming to a desired brim shape and having an opening to the cavity conforming to a cross-section of the desired brim shape for inserting the brim of the hat therein, the mitt covering the entire brim when the brim is fully inserted into the mitt cavity, the mitt comprising a stiff heat-resistant material and an insulative material layered between the mitt cavity and the stiff heat-resistant material;

exposing the hat with brim inserted into the mitt to drying means; and removing the hat from the mitt to produce a dry hat with a brim shaped into the desired brim shape.

14. A method for making a brim protector for a hat, the hat comprising a cap having a brim attached thereto, the method comprising:

forming a mitt configured with a cavity conforming to a desired brim shape and having an opening to the cavity conforming to a cross-section of the desired brim shape for inserting the brim of the hat therein, the mitt covering the entire brim when the brim is fully inserted into the mitt cavity, the mitt comprising a stiff heat-resistant material and an insulative material layered between the mitt cavity and the stiff heat-resistant material.

15. The method of claim 14, wherein the stiff heat-resistant material comprises steel reinforced polytetrafluaroethylene.

16. The method of claim 14, further comprising:

forming the mitt with an outer surface comprising a heat deflection coating.

17. The method of claim 16, wherein the heat deflection coating comprises polytetrafluaroethylene with a poly paraphenylene terephthalamide coating.

18. The method of claim 14, further comprising:

attaching a heat-resistant handle to an outer surface of the mitt.

19. The method of claim 18, further comprising:

coating an outer surface of the handle with a heat deflection coating.

* * * * *